United States Patent [19]

Halligan, Sr. et al.

[11] Patent Number: 4,986,389

[45] Date of Patent: Jan. 22, 1991

[54] SLIDABLE SAFETY NET ASSEMBLY

[75] Inventors: Christopher J. Halligan, Sr., Wellesley; Christopher J. Halligan, Jr., Gloucester, both of Mass.

[73] Assignee: Westerbeke Fishing Gear Co., Inc., Boston, Mass.

[21] Appl. No.: 538,038

[22] Filed: Jun. 13, 1990

[51] Int. Cl.[5] ..... E04G 21/32

[52] U.S. Cl. ..... 182/138

[58] Field of Search ..... 182/137, 138, 139

[56] References Cited

U.S. PATENT DOCUMENTS

| | | | |
|---|---|---|---|
| 567,642 | 9/1896 | Fitzhugh | 182/138 |
| 597,818 | 1/1898 | Fondu | 182/138 |
| 1,546,399 | 7/1925 | Moylan | 182/138 |
| 3,527,319 | 9/1970 | Pedley | 182/138 |
| 3,949,834 | 4/1976 | Nusbaum | 182/138 |
| 4,856,615 | 8/1989 | Nusbaum | 182/138 |
| 4,875,549 | 10/1989 | Denny | 182/138 |

FOREIGN PATENT DOCUMENTS

| | | | |
|---|---|---|---|
| 608311 | 1/1935 | Fed. Rep. of Germany | 182/138 |

*Primary Examiner*—Reinaldo P. Machado
*Attorney, Agent, or Firm*—Herbert L. Bello

[57] ABSTRACT

A safety net assembly for covering and uncovering a substantially rectangular open pit includes a safety net with a rope edging and a guide cable that is mounted about the perimeter of the pit, the guide cable defining a pair of track along which the safety net is slidably moved to its opened and closed positions. A plurality of closable links are attached to two sides and one end of the safety net and slidably mounted to the guide cable at two sides and one end of the pit. A plurality of snap rings are attached to the other end of the safety net and releasably attached to the guide cable at the other end of the pit. The links permit the safety net to be drawn open and closed, and the snap rings secure the safety net over the pit.

20 Claims, 3 Drawing Sheets

SLIDABLE SAFETY NET ASSEMBLY

BACKGROUND OF THE INVENTION

1. Field of Invention:

The present invention relates to safety nets and, more particularly, is directed towards a slidable safety net assembly for an open pit.

2. Description of the Prior Art:

Various types of safety nets have been designed for protecting workmen and other persons from hazardous conditions. U.S. Pat. Nos. 182,138; 3,527,319; and 4,856,615 disclose various safety net configurations specifically designed for use in buildings and buildings under construction.

Open pits, for example, grease pits, are used to inspect and work on the underside of an automobile. Rather than raising the automobile by means of a hydraulic lift, the automobile is driven over the open grease pit. A workman in the pit performs the necessary maintenance work, for example, replacing the oil filter lubricating the fittings and the like. Once the work has been completed, the automobile is driven away, leaving an open pit. The open pit is a hazard to those in the area adjacent the pit.

In order to prevent personnel from falling into the open pit, a covering of some type is placed over the pit area. The covering must be sufficiently strong to support anyone who might accidently fall into the pit. Solid covers, such as boards or sheets of metal or steel grids, are cumbersome and inconvenient to handle and store. Covering the open pit with a flexible safety net provides adequate protection, but it is a time consuming task to securely attach the safety net around the open pit each time that the safety net is put in place. Accordingly, prior art safety nets are not suited for use in situations in which the opened area is covered and uncovered frequently because of the length of time that it takes to cover and uncover the pit.

A need has arisen for a safety cover for an open pit which can be readily and easily moved between a covering position in which the pit is covered to an uncovered position in which access is provided to the pit.

SUMMARY OF THE INVENTION

It is an object of the present invention to provide a cover for an open pit which does not suffer from the disadvantages and limitations of prior art devices.

It is another object of the present invention to provide a safety net for an open pit which can be easily and quickly moved to cover and uncover the open pit.

It is further object of the present invention to provide a safety net assembly that is configured to be easily and quickly moved to cover and uncover a rectangularly shaped opened pit. The invention is characterized by a safety net assembly having a substantially rectangular shaped safety net with a rope edging, a guide cable or track, and a mounting system. The guide cable is secured about the perimeter of an open pit by means of eye bolts which are secured to the upper corners of the pit. The guide cable is made taut by means of turnbuckles at the back end of the pit. A plurality of closable links that can be easily opened and closed are provided for slidably holding the safety net to the guide cable. The rope edging and guide cable pass through each of the links for holding the back of the net to the back end of the pit and for slidably holding the sides of the safety net to the sides of the pit. Snap rings are provided for attaching the front end of the safety net to the front end of the guide cable, the snap rings being easily opened to release the guide cable.

In order to provide access to a covered pit, the snap rings are opened and disconnected from the guide cable, whereby the safety net is released from the front end of the pit. Then, the safety net, which is slidable held to the guide cable at the sides of the pit by means of the links, is drawn toward the back end of the pit to provide access thereto. To cover the open pit, the safety net is pulled forward to the front end of the pit and the snap rings are clipped onto the guide cable. The safety net is now secured to both sides of the pit as well as the front and rear ends.

Other objects of the present invention will in part be obvious and will in part appear hereinafter.

The invention accordingly comprises the apparatuses, systems, processes and products, together with their parts, steps, elements and interrelationships, that are exemplified in the following disclosure, the scope of which will be indicated in the appended claims.

BRIEF DESCRIPTION OF THE DRAWINGS

A fuller understanding of the nature and objects of the present invention will become apparent upon consideration of the following detailed description taken in connection with the accompanying drawings, wherein.

DETAILED DESCRIPTION OF THE PREFERRED EMBODIMENT

Figure 1:
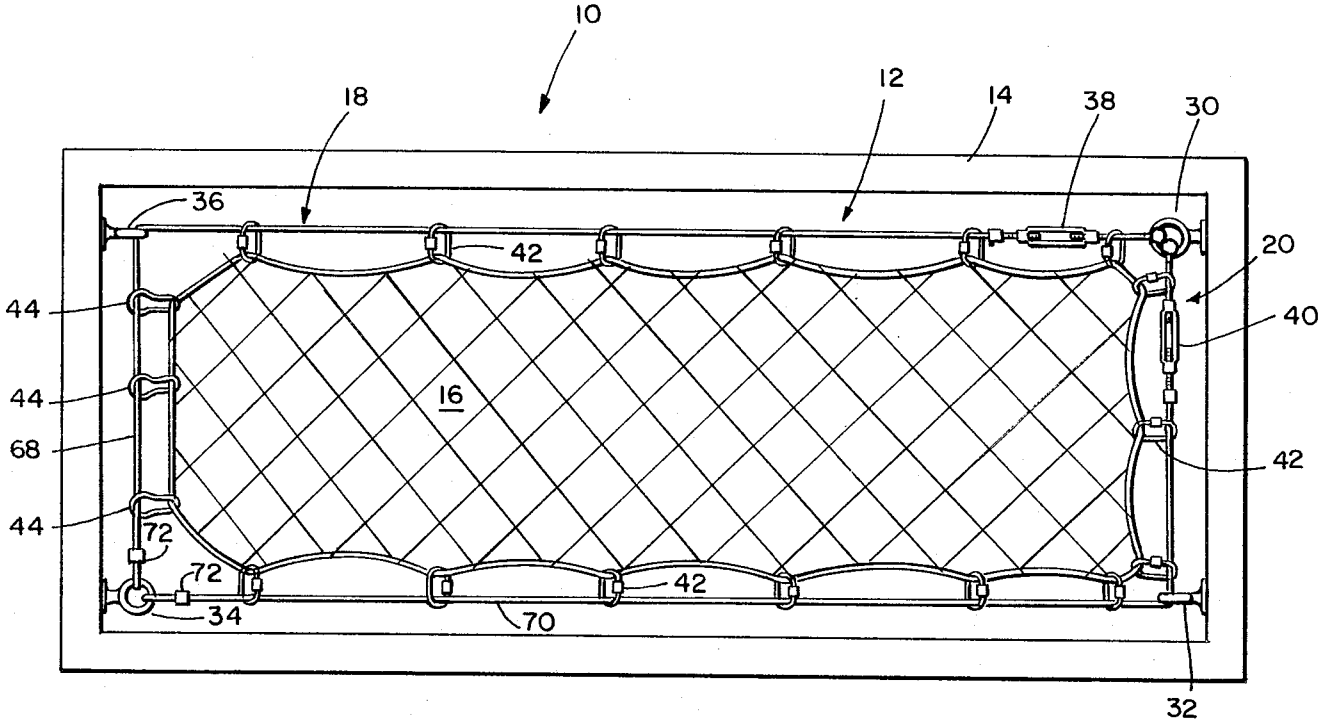
FIG. 1 is a plan view of a safety net assembly embodying the invention, the safety net assembly being installed over an open pit area.
Figure 3:
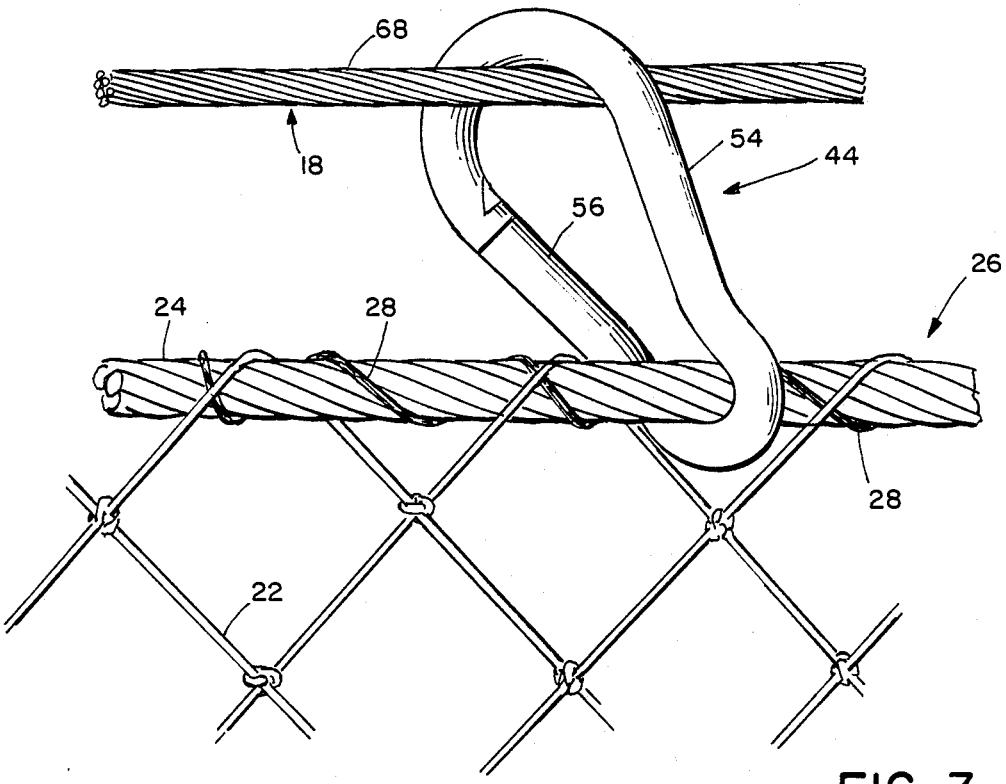
FIG. 3 is an enlarged view showing the safety net attached to the guide cable at the front end of the pit by means of a snap ring.
Figure 2:
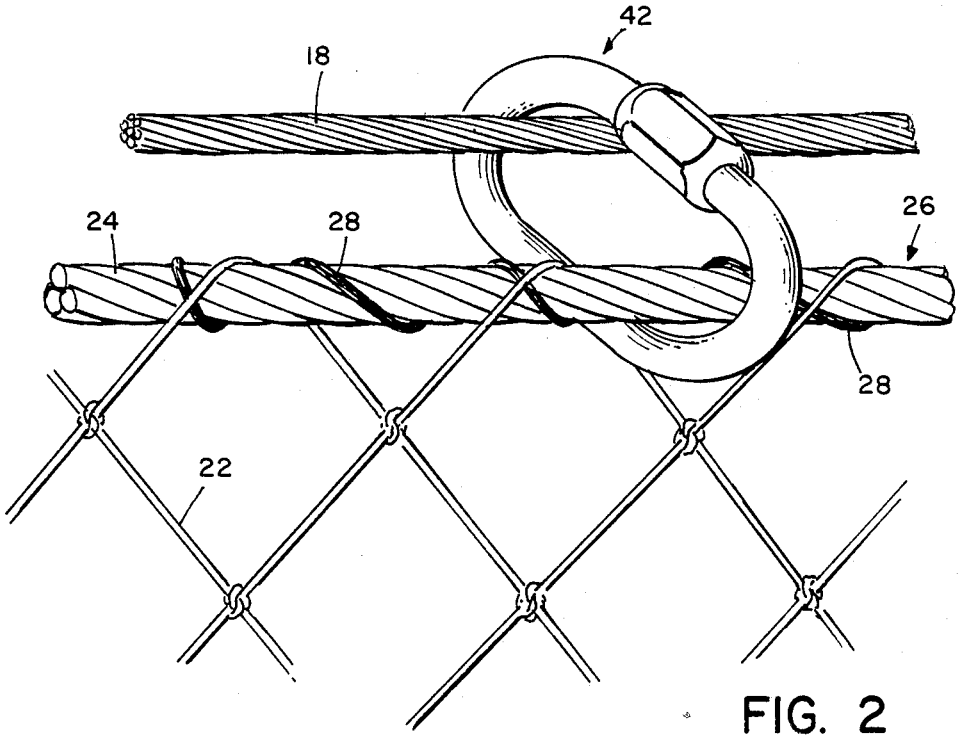
FIG. 2 is an enlarged view showing the safety net attached to the guide cable at one side of the pit by means of a closable link.

Referring now to the drawings, particularly FIG. 1, there is shown a safety net assembly 10 embodying the present invention. Safety net assembly 10 is shown installed over an open pit 12, for example, a grease pit of the type used for servicing the underside of an automobile. Grease pit 12 is a substantially rectangular opening having a structural member 14, such as a metal frame, disposed at the corners or about the upper peripheral edge thereof.

Safety net assembly 10 includes a safety net 16, a guide cable 18 and a mounting system 20 for attaching the safety net and guide cable. Safety net 16 has a plurality of interwoven, substantially diamond-shaped members 22. A line 24, for example a 1/2 inch braided Nylon line, is threaded through the outermost members 22 to provide safety net 16 with a rope edging 26. A thin line 28 is tied about line 24 and safety net 16 to hold the safety net in place on rope edging 26. Safety net assembly 10 is fastened to the peripheral edges of pit 12 by means of guide cable 18 and mounting system 20.

As best shown in FIG. 1, guide cable 18 is attached to frame 14 by means of eye bolts 30, 32, 34 and 36. Eye bolts 30 and 32 are secured to frame 14 at the back or foot end of pit 12, and eye bolts 34 and 36 are secured to the frame at the front or head end of the pit. Guide cable 18 is threaded through eye bolts 30, 32, 34 and 36, and made taut by means of turnbuckles 38 and 40 which are connected to the guide cable.

Safety net 16 is attached to cable guide 18 by means of mounting system 20 which includes a plurality of closable links 42 and a plurality of snap rings 44. Closable links 42 slidable hold safety net 16 to guide cable 18 at the sides and back end of pit 12. Snap rings 44 define quick release means for rapidly connecting and releasing safety net 16 from cable guide 18 at the front end of pit 12. It is to be noted that eyebolts 30, 32, 34 and 36 are mounted at the front end and back end of pit 12 so that there is no obstruction to block links 42 from sliding along guide cable 18.

In the illustrated embodiment, the heads of eyebolts 30 and 34 are horizontally disposed and the heads of eyebolts 32 and 34 are vertically disposed. With the exception of turnbuckle 38, which is attached to guide cable 18 at the back end of pit 12, links 42 are freely slidable on the guide cable. It is to be noted that the portions of guide cable 18 that are disposed along the sides and ends of pit 12 are in close parallel relationship thereto in order to prevent personnel from falling into the pit when safety net 16 is secured in its closed position. The details of links 42 and snap rings 44 are shown in FIGS. 4, 5, 6 and 7.

Figure 5:
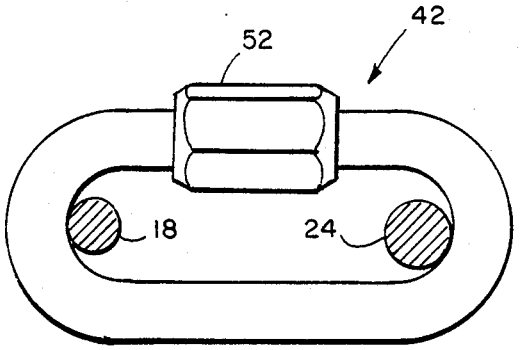
FIG. 5 is a side elevation of a closable link in its closed position.
Figure 4:
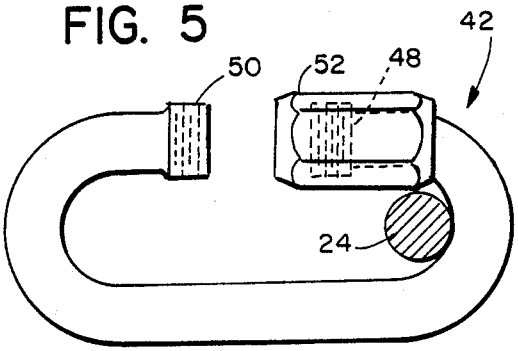
FIG. 4 is a side elevation of a closable link in its opened position.

Link 42 is shown in its opened position in FIG. 4 and in its closed position in FIG. 5. Each link 42 includes a body 46 having a circular profile in right cross-section that is formed into an oval-shaped, opened link. As best shown in FIG. 4, body 46 terminates in a pair of enlarged threaded ends 48 and 50 that are separated from one another. An internally threaded locking member 52 is sized and shaped to be threaded on both ends 48, 50, as shown in FIG. 5, to form a closed link, the front end of locking member 52 being turned onto end 50. To open link 42, locking member 52 is turned so that it is backed off of end 50. Links 42 are constrained for limited movement relative to safety net 16 and are freely slidable on guide cable 18, the inner oval opening of each link 42 being sized and shaped to loosely receive cable guide 18 and rope edging 26.

Figure 7:
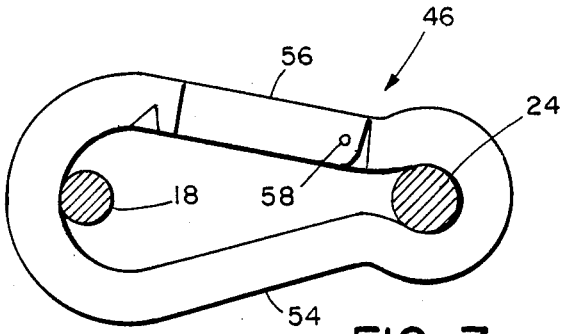
FIG. 7 is a side elevation of a snap ring in its closed position.
Figure 6:
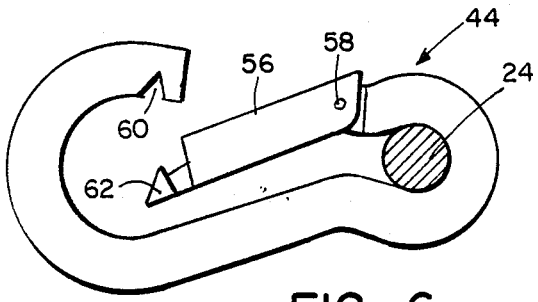
FIG. 6 is a side elevation of a snap ring in its opened position.

Snap ring 44 is shown in its opened position in FIG. 6 and in its closed position in FIG. 7. Snap ring 44 includes a substantially J-shaped body or hook 54 and a biased or spring loaded closing arm 56 that is pivotally mounted to the body by means of a pin 58. Hook 54 is formed with a notch 60 and arm 56 is provided with a mating latch 62. When arm 56 is pushed toward the central opening of hook 54, snaps ring 44 is opened. When arm 56 is released, latch 62 and notch 60 lockingly engage one another. The inner opened portion of closed snap ring 44 is sized and shaped to loosely receive cable guide 18 and rope edging 26.

Figure 8:
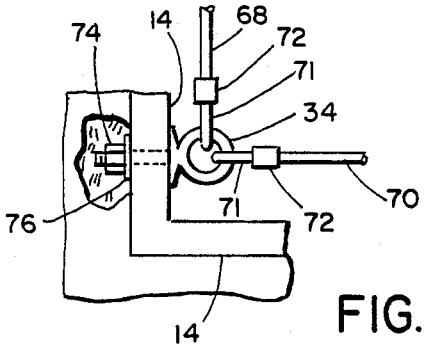
FIG. 8 is a top plan view showing the attachment of the guide cables to an eyebolt.

In the illustrated embodiment, by way of example, guide cable 18 is comprised of a pair of cables 68 and 70, for example ¼ inch galvanized aircraft cable. Cable 68 and 70 are attached to eyebolt 34 by means of eyes 71 at the ends of the cables. Eyebolt 34 is secured to frame 14 by means of a nut 74 and a washer 76. As shown in FIG. 8, swage fittings 72 are used to form eyes at the ends of guide cables 68 and 70. The free or other ends of guide cables 68 and 70 are attached to turnbuckles 38 and 40, respectfully. The portion of guide cables 68 and 70 that are disposed along the sides of pit 12 define unobstructed tracks on which links 42 are freely slidable for opening and closing safety net 16.

Figure 9:
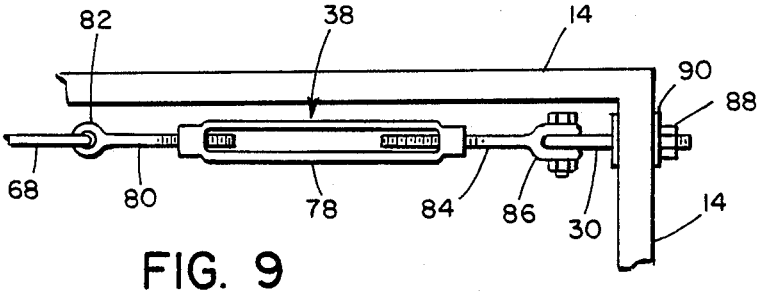
FIG. 9 is a side view showing the attachment of a turnbuckle to an eyebolt.

Referring now to FIG. 9, it will be seen that turnbuckle 38 includes a main body 78, a threaded rod 80 with an eye 82 at its end, and a threaded rod 84 with a shackle 86 at its end. Rods 80 and 84 are turned into opposite ends of body 78. Guide cable 68 is attached to eye 82 and shackle 86 is attached to eyebolt 30. Eyebolt 30 is secured to frame 14 by means of a nut 88 and a washer 90. Cable 70 is attached to turnbuckle 40 and turnbuckle 40 is attached to eyebolt 30 in the same manner as described for turnbuckle 38. In a conventional fashion, cable 68 and 70 are made taut by turning turnbuckles 38 and 40. Once guide cables 68 and 70 have been attached and made taut, links 42 are opened and attached to rope guide 26 and guide cables 68, 70 at the sides and back end of pit 12. Preferably, links 42 are set apart fifteen inches. Finally, snap rings 44 are attached to rope edging 26 and guide cable 68 at the front end of pit 12. It is to be understood that guide cable 18 is disposed in juxtaposition and spaced parallel relationship with the sides of pit 12 so as to block access to the pit and prevent personnel from accidentally falling into the pit when safety net 16 is drawn closed and snap rings 44 are clipped onto guide cable 18 at the front end of the pit.

In its closed position, as shown in FIG. 1, safety net 16 is positioned generally horizontally across pit 12. In this position, safety net 16 is drawn to cover pit 12 and snap rings 44 are clipped onto guide cable 18 at the front end of the pit. Access to pit 12 is obtained by first opening snap rings 44 and disconnecting them from guide cable 18. Then, safety net 16 is drawn back towards the back end of pit 12, links 42 easily sliding on guide cable 18.

Since certain changes may be made in the foregoing disclosure without departing from the scope of the invention herein involved, it is intended that all matter contained in the above description and depicted in the accompanying drawings be construed in an illustrative and not in a limiting sense.

What is claimed is:

1. A safety net assembly configured to be positioned generally horizontally across an open, substantially rectangular pit area, said assembly comprising:

(a) guide cable means mounted about the top of the rectangular area at the corners thereof;

(b) a substantially rectangular safety net that is sized and shaped to be positioned generally horizontally across the open area to prevent access thereto, (c) means for attaching said safety net to said guide cable means positioned along the sides and one end of the open area, said attaching means mounted to the sides and one end of said safety net, said attaching means constrained for limited movement relative to said safety net, said attaching means configured to be slidably attached to said guide cable means disposed along the sides of the open area; and (d) quick release attaching means for attaching said safety net to said guide cable means positioned along the other end of the open area, said quick release attaching means constrained for limited movement relative to said safety net, said quick release attaching means configured to be clipped onto and easily released from engagement with said guide cable means;

(e) said safety net is slidable along said guide cable means when said quick release means is out of engagement with said guide cable means, access to the open area being provided by drawing said safety net toward the one end of the open area when said quick release means and said guide cable means are out of engagement;

(f) said safety net positioned generally horizontally across the open area and preventing access thereto when said quick release attaching means and said guide cable means at the other end of the open area are in engagement.

2. The safety net assembly as claimed in claim 1 wherein said safety net has a rope edging, said means for attaching and said quick release attaching means sized and shaped to receive said rope edging.

3. The safety net assembly as claimed in claim 2 wherein said attaching means closable is a plurality of links having a substantially oval-shaped open body and a locking member, each said movable member being movable between an opened and a closed position, each said link having a central, oval-shaped opening, said locking member defining a movable member for opening its associated link to permit said rope edging and said guide cable means to be positioned within said central opening and secured therein when said movable member is moved to its closed position.

4. The safety net assembly as claimed in claim 1 wherein said mounting means includes a plurality of eyebolts, each eyebolt having a threaded body that terminates in an eye, one of said eyebolts mounted to each corners of the pit at the upper periphery thereof, said body of each said eyebolt secured to the corners of the pit so that said eye of each said eyebolt is positioned to receive said guide cable means, said guide cable means being threaded through said eyes.

5. The safety net assembly as claimed in claim 4 including means for making said guide cable means taut.

6. The safety net assembly as claimed in claim 5 wherein said means for making said guide cable means taut is turnbuckle means.

7. The safety net assembly as claimed in clam 1 wherein said quick release attaching means is snap ring means.

8. The safety net assembly as claimed in claim 7 wherein said snap ring means includes a substantially J-shaped hook portion and a biased closing arm.

9. A safety net assembly configured to be positioned generally horizontally across an open, substantially rectangular pit area having a structural member adjacent the corners thereof, said assembly comprising:

(a) guide cable means;

(b) mounting means for mounting said guide cable means to the structural members adjacent the corners of the open area;

(c) a substantially rectangular safety net that is sized and shaped to be positioned generally horizontally across the open area to prevent access thereto;

(d) attaching means for attaching said safety net to said guide cable means positioned along the sides and one end of the open area, said attaching means mounted to the sides and one end of said safety net, said attaching means constrained for limited movement relative to said safety net, said attaching means configured to be slidably attached to said guide cable means disposed along the sides of the open area; and (e) quick release attaching means for attaching said safety net to said guide cable means that is positioned along the other end of the open area, said quick release attaching means constrained for limited movement relative to said safety net, said quick release attaching means configured to be clipped onto and easily released from engagement with said guide cable means;

(f) said safety net is slidable along said guide cable means when said quick release means is out of engagement with said guide cable means, access to the open area being provided by drawing said safety net toward the one end of the open area when said quick release means and said guide cable means are out of engagement;

(g) said safety net positioned generally horizontally across the open area and preventing access thereto when said quick release attaching means and said guide cable means at the other end of the open area are in engagement.

10. The safety net assembly as claimed in claim 9 wherein said mounting means includes a plurality of eyebolts, each said eyebolt having a threaded body that terminates in an eye, one eyebolt mounted to each one of the structural members, said body of each said eyebolt secured to the structural members so that said eye of each said eyebolt is positioned to receive said guide cable means, said eye of each said eyebolt sized to slidably receive said guide cable means, said guide cable means being threaded through said eyes.

11. The safety net assembly as claimed in claim 9 wherein said attaching means is a plurality closable links having a substantially oval-shaped, open body and a locking member, each said movable member being movable between an opened and a closed position, each said link having a central, oval-shaped opening, said locking member defining a movable member for opening its associated link to permit said safety net and said guide cable means to be positioned within said central opening and secured therein when said movable member is moved to its closed position.

12. The safety net assembly as claimed in claim 9 including means for making said guide cable means taut.

13. The safety net assembly as claimed in claim 12 wherein said means for making said guide cable means taught is turnbuckle means.

14. The safety net assembly as claimed in claim 9 wherein said quick release attaching means is snap ring means.

15. The safety net assembly as claimed in claim 14 wherein said snap ring means includes a substantially J-shaped hook portion and a biased closing arm.

16. A safety net assembly configured to be positioned generally horizontally across an open, substantially rectangular pit area having a structural member adjacent the corners thereof, said assembly comprising:

(a) guide cable means;

(b) mounting means for mounting said guide cable means to the structural members adjacent the corners of the open area;

(c) a substantially rectangular safety net with a rope edging, said safety net is sized and shaped to be positioned generally horizontally across the open area to prevent access thereto;

(d) attaching means configured to engage said guide cable means and said rope edging for attaching said safety net to said guide cable means positioned along the sides and one end of the open area, said attaching means mounted to said rope edging along the sides and one end of said safety net, said attaching means constrained for limited movement relative to said safety net, said attaching means configured to be slidably attached to said guide cable means disposed along the sides of the open area; and (e) quick release attaching means configured to engage said guide cable means and said rope edging for attaching said safety net to said guide cable means that is positioned along the other end of the open area, said quick release attaching means constrained for limited movement relative to said safety net, said quick release attaching means configured to be clipped onto and easily released from engagement with said guide cable means;

(f) said safety net is slidable along said guide cable means when said quick release means is out of engagement with said guide cable means, access to the open area being provided by drawing said safety net toward the one end of the open area when said quick release means and said guide cable means are out of engagement;

(g) said safety net positioned generally horizontally across the open area and preventing access thereto when said quick release attaching means and said guide cable means at the other end of the open area are in engagement.

17. The safety net assembly as claimed in claim 16 wherein said mounting means includes a plurality of eyebolts, each said eyebolt having a threaded body that terminates in an eye, one eyebolt mounted to each one of the structural members, said body of each said eyebolt secured to the structural members so that said eye of each said eyebolt is positioned to receive said guide cable means, said eye of each said eyebolt sized to slidably receive said guide cable means, said guide cable means being threaded through said eyes.

18. The safety net assembly as claimed in claim 16 wherein said attaching means is a plurality closable links having a substantially oval-shaped, open body and a locking member, said movable member being movable between an opened and a closed position, each said link having a central, oval-shaped opening, said locking member defining a movable member for opening its associated link to permit said rope edging and guide cable means to be positioned within said central opening and secured therein when said movable member is moved to its closed position.

19. The safety net assemble as claimed in claim 18 including turnbuckle means for making said guide cable means taut.

20. The safety net assembly as claimed in claim 19 wherein said quick release attaching means is at least two snap rings means, each said snap ring means having a substantially J-shaped hook portion and a biased closing arm.

* * * * *